US005341762A

United States Patent [19]

Petersen

[11] Patent Number: 5,341,762

[45] Date of Patent: Aug. 30, 1994

[54] ULTRASONIC PEST CONTROL DEVICE AND METHOD FOR CONSTRUCTING THE SAME

[75] Inventor: Robert L. Petersen, Kentfield, Calif.

[73] Assignee: Viprotec, Beverly Hills, Calif.

[21] Appl. No.: 11,960

[22] Filed: Feb. 1, 1993

[51] Int. Cl.[5] ..... G10K 5/02; G10K 7/06

[52] U.S. Cl. ..... 116/137 A; 116/22 A; 116/141

[58] Field of Search ..... 116/22 A, 24, 137 R, 116/137 A, 141; 367/137, 139

[56] References Cited

U.S. PATENT DOCUMENTS 3,185,446 5/1965 Blanchard ..... 116/137 A X
3,432,804 3/1969 Beeken ..... 116/137 A X

FOREIGN PATENT DOCUMENTS 1127764 4/1962 Fed. Rep. of Germany ... 116/137 A

*Primary Examiner*—William A. Cuchlinski, Jr.
*Assistant Examiner*—Willie Morris Worth
*Attorney, Agent, or Firm*—Lyon & Lyon

[57] ABSTRACT

An ultrasonic transmitter and methods for making the same. A plurality of blocks are provided and are formed such that, when they are coupled together, they form at least one ultrasonic whistle in fluid communication with a manifold and an acoustic horn.

15 Claims, 19 Drawing Sheets

ULTRASONIC PEST CONTROL DEVICE AND METHOD FOR CONSTRUCTING THE SAME

BACKGROUND OF THE INVENTION

The field of the present invention is ultrasonic transmitters and, more particularly, ultrasonic pest control devices and methods for constructing the same.

It is well known that pest infestation is a primary cause of damage to stored materials and foodstuffs each year, and that damage resulting from pest infestation causes the agricultural and food and beverages industries, both in this country and worldwide, to suffer substantial losses each year. In addition, it is well known that many pests, including rodents, insects, and birds, find ultrasonic sound waves of certain frequencies to be disturbing or unpleasant, and that under the right conditions ultrasonic sound waves may be used to drive pests away from a given area. For this reason, numerous electronic and mechanical ultrasonic pest control devices have been developed as a means for driving pests away from food and materials storage facilities. However, these prior devices have not proven to be as reliable, economical to manufacture, and capable of ready adaptation to a broad range of environments as is desirable.

For example, those skilled in the art will appreciate that electronic ultrasonic pest control devices are prone to damage and disfunction at preferred output intensities. More specifically, it has been found that to drive pests away from a given area it is preferable to bathe the area in ultrasonic waves having a magnitude of at least 100 db, and that, while some electronic devices are capable of bathing small areas in ultrasonic waves of sufficient magnitude, these devices simply will not withstand operation at output intensities sufficient to cover large areas.

With respect to non-electronic ultrasonic pest control devices, those skilled in the art will appreciate that the issue is not operability or reliability, as numerous ultrasonic whistles have been developed and are capable of producing ultrasonic outputs in the magnitude ranges suggested above. Instead, the issues are cost, ease of manufacture, and ease of customization to a given area or volume of interest. As shown in U.S. Pat. No. 3,138,138, issued to Quittner (hereinafter the "Quittner patent"), and in U.S. Pat. No. 3,277,861, issued to Moe (hereinafter the "Moe patent"), conventional ultrasonic "whistle based" devices generally comprise a source of compressed fluid (air in most cases), an internal tubing network, a valve assembly, and one or more ultrasonic whistles. In use, the compressed fluid source delivers fluid under pressure to the tubing network, the tubing network conveys the fluid to the whistle or whistles, and the valve assembly provides a means for controlling the volume of the fluid which is delivered to the whistle or whistles from the tubing network. Although the assembly of these devices is relatively simple and straight forward, it will be noted that difficulties may arise in customizing these devices to treat areas of varying sizes and dimensions or to rid an area of multiple types of pests. For example, the devices disclosed in the Quittner and Moe patents must be modified substantially to direct sound waves bi-directionally or multidirectionally. Further, it will be noted that the bonding or welding of the tubes comprising the ultrasonic pest control devices of the prior art is a labor intensive and time consuming process.

Accordingly, a need exists for an improved ultrasonic transmitter, and in particular, a need exists for an improved ultrasonic pest control device, which may be readily manufactured or modified to meet the needs of a given area of pest infestation.

SUMMARY OF THE INVENTION

The present invention is directed to an improved ultrasonic transmitter, which in one form may be used as an ultrasonic pest control device, and to methods for constructing the same. To this end, an ultrasonic transmitter embodying one form of the present invention comprises a plurality of blocks which, when coupled together, form at least one ultrasonic whistle in fluid communication with a manifold and an acoustic horn. Importantly, by varying the number of ultrasonic whistles formed between the blocks, it is possible to substantially increase or decrease the intensity of the ultrasonic waves produced by the device. Thus, the ultrasonic transmitter of the present invention may be readily adapted to drive pests from either a large or small area. Further, if the dimensions of the ultrasonic whistles are varied, the ultrasonic waves generated by the respective ultrasonic whistles will vary in frequency and will interact to form an ultrasonic wave having a modulated frequency or, stated differently, a sound having a polychromatic content. This may be advantageous, as it has been found that, if pests are exposed over long periods of time to ultrasonic waves of a single frequency, the pests will often adapt or develop a deafness immunity to ultrasonic waves of that frequency. In contrast, when pests are exposed to ultrasonic waves of different frequencies, the pests are less likely to adapt or acquire deafness immunity. Finally, as will be set forth more fully below, it may be noted that by changing the shape of the blocks, and also by providing additional ultrasonic whistles, the ultrasonic transmitter of the present invention may be altered to provide for bidirectional or even multidirectional transmission. Accordingly, an ultrasonic transmitter in accordance with the present invention may be readily adapted to meet not only the requirements of areas varying in size, but also the requirements of areas varying in shape.

In one preferred form, the ultrasonic transmitter of the present invention comprises a plurality of blocks which are capable of mating, e.g., in a tongue and groove fashion, and which have a plurality of cuts formed therein. The cuts comprise various portions of at least one ultrasonic whistle, and when the blocks are mated, the cuts combine to form the at least one ultrasonic whistle. Further, at least one block of the plurality has a manifold formed therein, and at least one block of the plurality has an acoustic horn formed therein. The acoustic horn is capable of fluid communication with one of the cuts forming the at least one ultrasonic whistle, and the manifold is capable of fluid communication with at least another of the cuts forming the ultrasonic whistle. As indicated above, and explained in still further detail below, by varying the shape of the blocks, and/or by providing additional ultrasonic whistles and acoustic horns, bidirectional or even multidirectional transmission of ultrasonic waves may be achieved.

In another preferred form, the ultrasonic transmitter of the present invention comprises a pair of end units, one or more working units disposed between the end units, and (if desired) one or more spacer units disposed between or adjacent to the working units. When the various units comprising the ultrasonic transmitter are coupled together, the "ganged assembly" forms at least one ultrasonic whistle in fluid communication with a manifold and an acoustic horn (i.e. the ganged assembly forms at least one ultrasonic whistle functional unit). More specifically, each working unit comprises a plate (or a block) having a multi-regioned aperture formed therein. The multi-regioned aperture comprises a manifold region, a reservoir region, a resonating chamber region, and a horn region. When a working unit is disposed between (and, thus, bounded by) a pair of end units, a pair of spacer units, or a combination thereof, the bounded reservoir region forms a settling reservoir, the bounded resonating chamber region forms a resonating chamber, and the two bounded regions in combination form an ultrasonic whistle. In addition, the manifold region forms a section of a manifold which is open to the settling reservoir, and the horn region forms a section of an acoustic horn which is in fluid communication with the resonating chamber.

As in the case of the first preferred embodiment, the second preferred embodiment of the present invention may be modified to treat a large or small area of pest infestation by modifying the number of ultrasonic whistle functional units provided. Also, by varying the dimensions of the resonating chambers of various ultrasonic whistle functional units frequency variation may be achieved. Finally, as in the case of the first preferred form, an ultrasonic transmitter in accordance with a second preferred form of the present invention may be readily adapted to provide for bidirectional or multidirectional transmission.

Accordingly, it is an object of the present invention to provide an improved ultrasonic transmitter and methods for constructing the same.

BRIEF DESCRIPTION OF THE DRAWINGS

FIG. 1(*b*) is a cross-sectional view of an ultrasonic whistle functional unit in accordance with a preferred form of the present invention.

FIG. 3(*b*) is a top view of a manifold block which forms one portion of an ultrasonic transmitter in accordance with a first preferred form of the present invention. FIG. 3(*c*) is a cross-Sectional view of a manifold block which forms one portion of an ultrasonic transmitter in accordance with a first preferred form of the present invention. FIG. 4(*b*) is a bottom view of a horn block which forms one portion of an ultrasonic transmitter in accordance with a first preferred form of the present invention. FIG. 4(*c*) is a cross-sectional view of a horn block which forms one portion of an ultrasonic transmitter in accordance with a first preferred form of the present invention. FIG. 4(*d*) is a top view of a horn block which forms one portion of an ultrasonic transmitter in accordance with a first preferred form of the present invention.

FIG. 6(*b*) illustrates a spacer unit which may form one portion of an ultrasonic transmitter in accordance with a second preferred form of the present invention.

FIG. 6(*c*) illustrates a port cap unit which forms one portion of an ultrasonic transmitter in accordance with a second preferred form of the present invention.

FIG. 6(*d*) illustrates an end cap unit which forms one portion of an ultrasonic transmitter in accordance with a second preferred form of the present invention.

FIG. 8(*d*) illustrates a bidirectional working unit of an ultrasonic transmitter in accordance with a second preferred form of the present invention.

FIG. 10(*b*) illustrates the connection of a plurality of ultrasonic transmitters to separate fluid source lines.

DESCRIPTION OF THE PREFERRED EMBODIMENTS

Figure 1A:
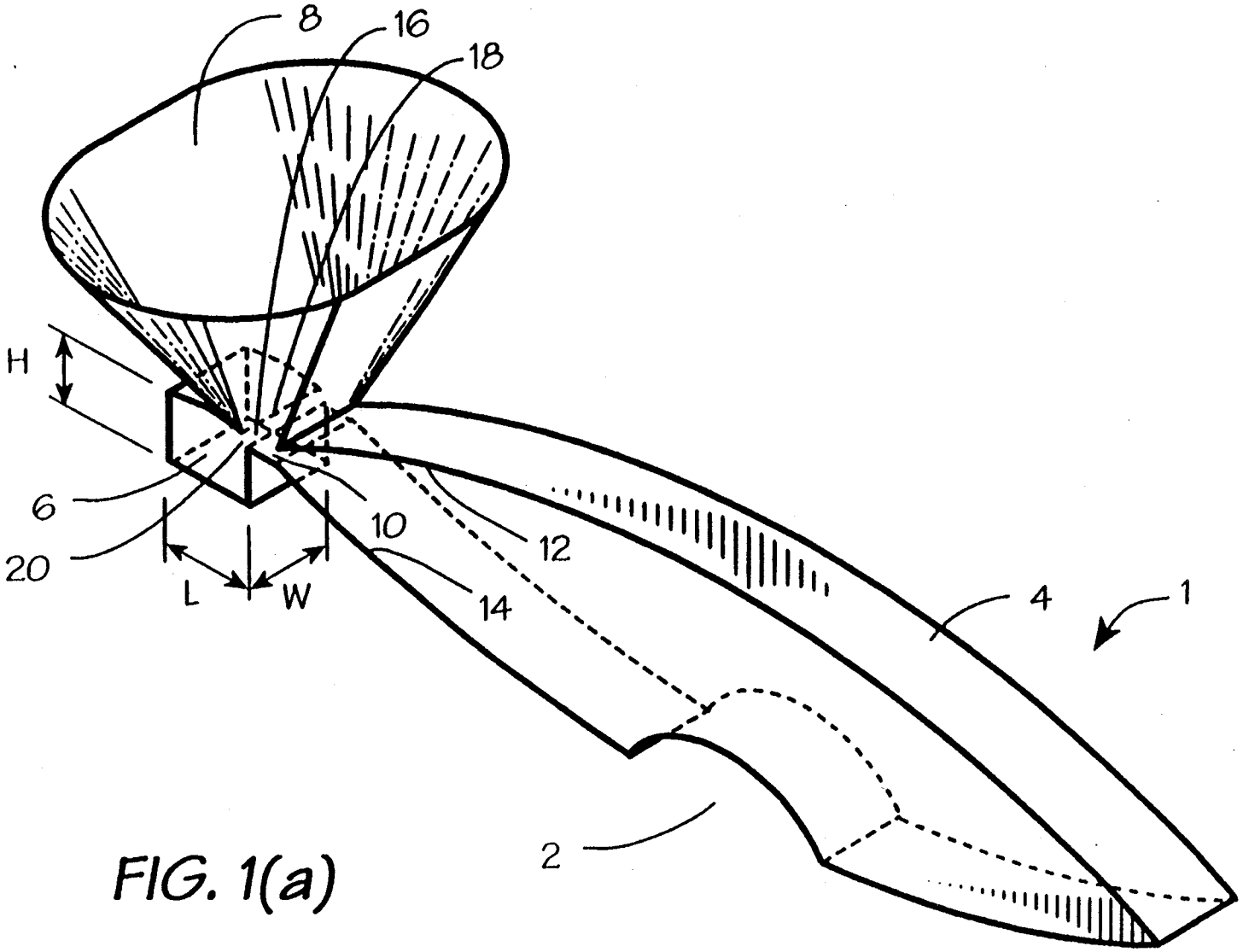
FIG. 1(*a*) illustrates an ultrasonic whistle functional unit in accordance with a preferred form of the present invention.
Figure 1B:
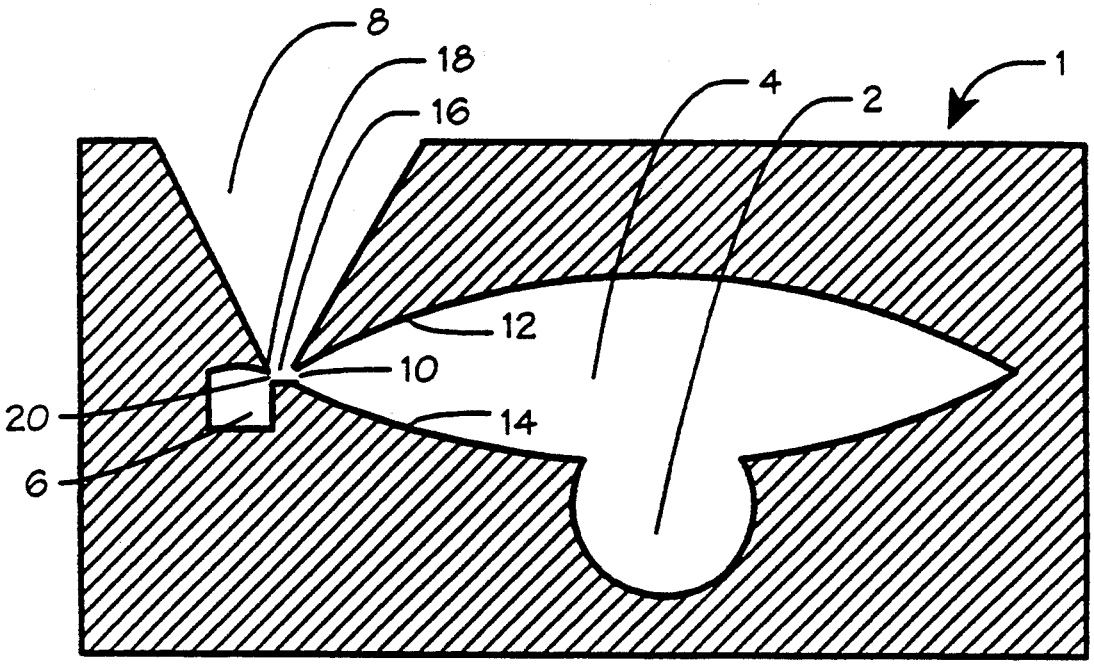

Turning now to the drawings, FIGS. 1(*a*) and 1(*b*) provide illustrations of an ultrasonic whistle functional unit 1 in accordance with a preferred form of the present invention. The ultrasonic whistle functional unit 1 comprises a manifold 2, a settling chamber 4, a resonating chamber 6, and an acoustic horn 8. In use, air (or any other compressible fluid) is bled from the manifold 2 into the settling chamber 4. The settling chamber 4 functions as a reservoir and has a nozzle 10 formed at one end. Neither the settling chamber 4 nor the nozzle 10 need conform to any particular shape. However, it is preferred that the walls 12 and 14 of the settling chamber 4 which form the nozzle 10 converge in some fashion such that the air delivered by the nozzle 10 across the gap 16 (between the settling chamber 4 and the resonating chamber 6) will be smoothed to a point of laminar flow. Further, to minimize turbulence within the settling chamber 4, it is preferred that the manifold 2 open into a central, rather than an end, portion of the settling chamber 4.

The nozzle 10 focuses the laminar flow of air against a knife-edge 18. As the laminar air flow engages the knife-edge 18, turbulence is produced within the air flow, and a polychromic source of sound is thereby generated.

Figure 7:
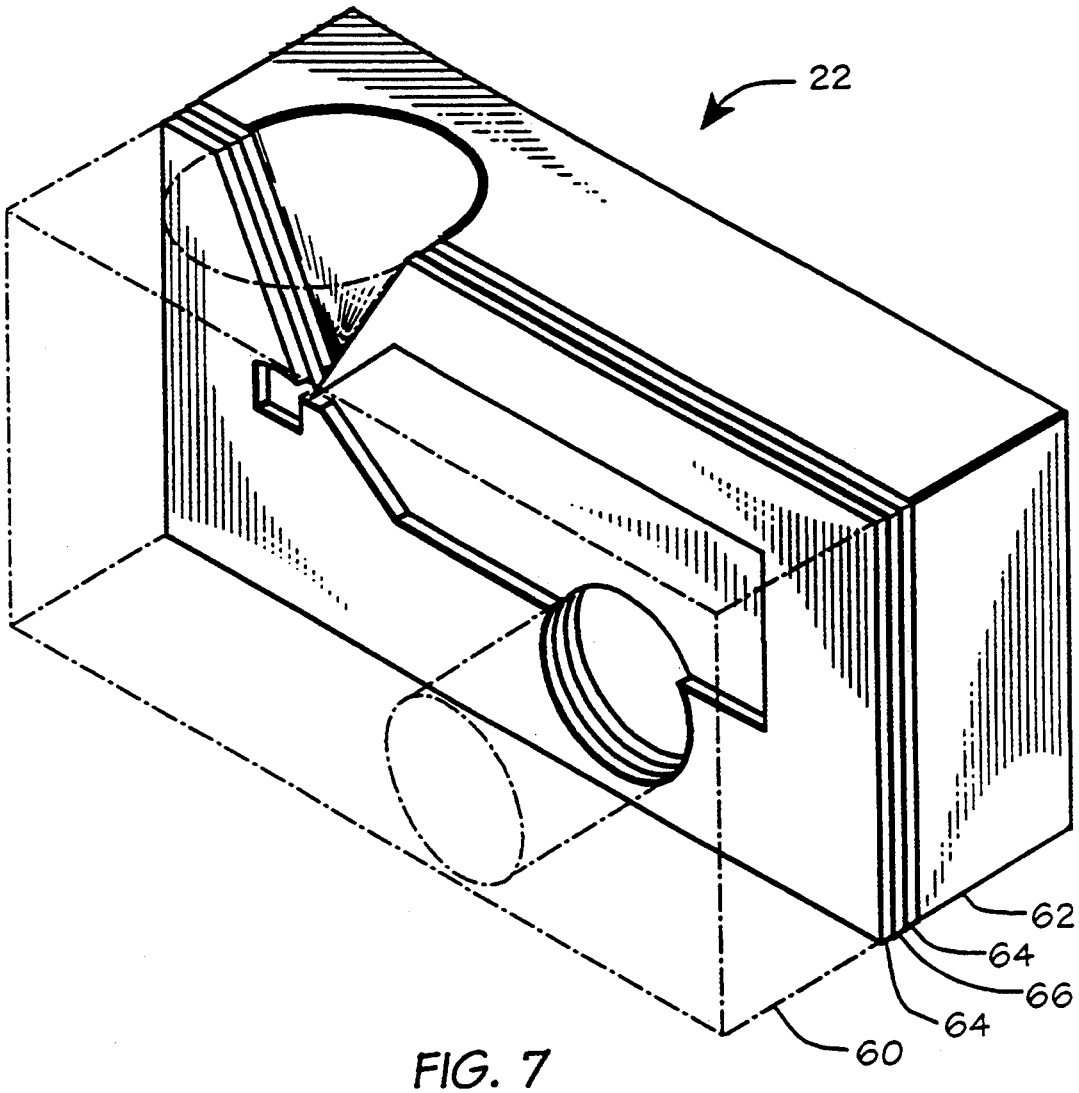
FIG. 7 illustrates an ultrasonic transmitter in accordance with a second preferred form of the present invention.

As will be appreciated by those skilled in the art, when turbulent fluid flow occurs at or near an open end of a resonating column filled with a compressible fluid, a displacement standing wave will be produced within the column. Further, the frequency (f) of the standing wave produced may be calculated in accordance with equation (1):

$$f=(\tfrac{1}{4})(v/l); \quad (1)$$

where (v) represents the velocity at which the displacement standing wave travels within the fluid, and (l) represents the length of the resonating column. It follows that the turbulence produced at the opening 20 to resonating chamber 6 may be used to create displacement standing waves within the resonating chamber 6, and that the frequencies of the standing waves produced will vary as the dimensions of the resonating chamber 6 are varied. In the preferred form standing waves of a single frequency are not produced. Instead, a large number of standing waves having frequencies which fall within a given band are produced. For example, it is presently preferred that the ultrasonic whistle functional units 1 comprising the ultrasonic transmitter 22 (shown in FIG. 2 and 7) of the present invention generate standing waves having frequencies which fall within a band centered at approximately 28 kHz, as ultrasonic waves in the 28 kHz range have been found to be particularly effective in driving rats from a given area. To produce such waves it is presently preferred that the resonating chamber 6 measure approximately 0.12 inches in length L, 0.06 inches in width W, and 0.10 inches in height H. It should be noted however that it is not intended to limit the scope of the present invention to any particular frequency or to any particular application, as it is believed that the general concept of the invention may be implemented at any of a number of frequencies, that the concept of the invention may be used to rid a given area of any of a number of pests, including (for example) other rodents, insects, and birds, and that the general concept of the invention may prove to be advantageous in many other ultrasonic applications.

Finally, the resonating cavity 6 and its associated knife-edge 18 are coupled through the fluid medium (air) to the acoustic horn 8. The acoustic horn 8 acts as an impedance matching device which efficiently transfers the acoustic energy generated by the displacement standing waves to the surrounding environment. Although the acoustic horn 8 depicted in the drawings has a conical shape or profile, it may be advantageous to alter the shape of the acoustic horn 8. For example, it may be desirable to utilize an acoustic horn 8 having an exponential shape or profile.

Figure 2:
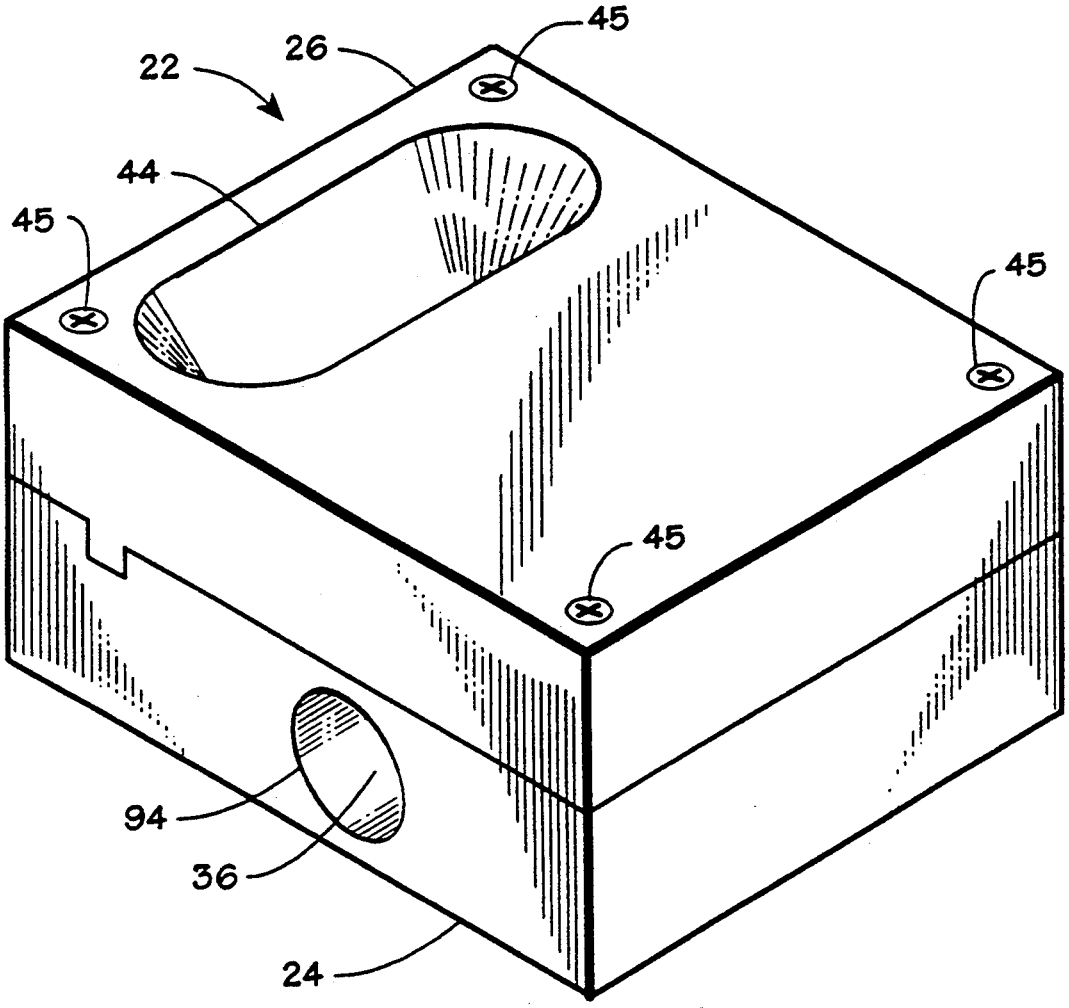
FIG. 2 is an illustration of an ultrasonic transmitter in accordance with a first preferred form of the present invention.
Figure 3A:
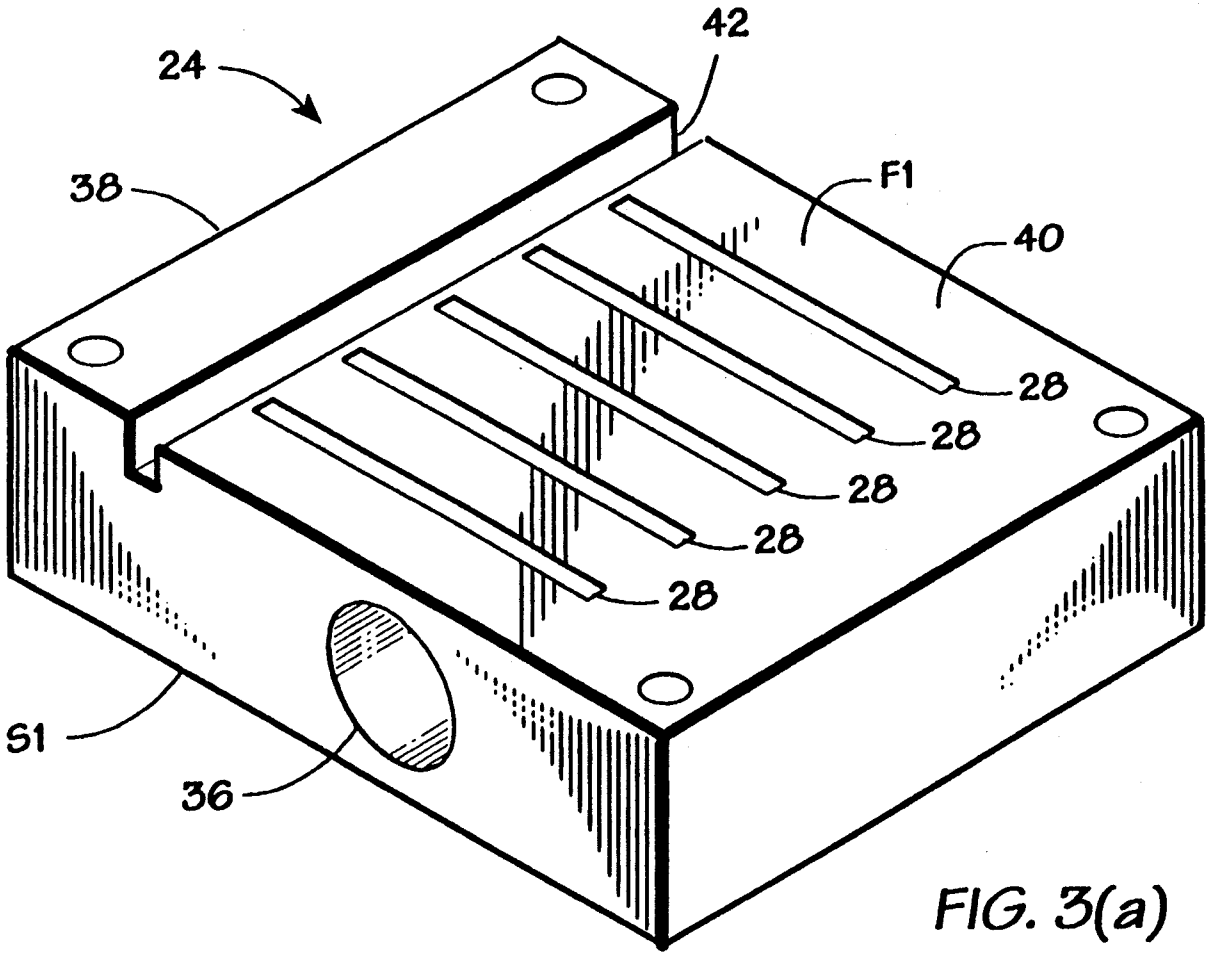
FIG. 3(*a*) is an illustration of a manifold block which forms one portion of an ultrasonic transmitter in accordance with a first preferred form of the present invention.
Figure 3B:
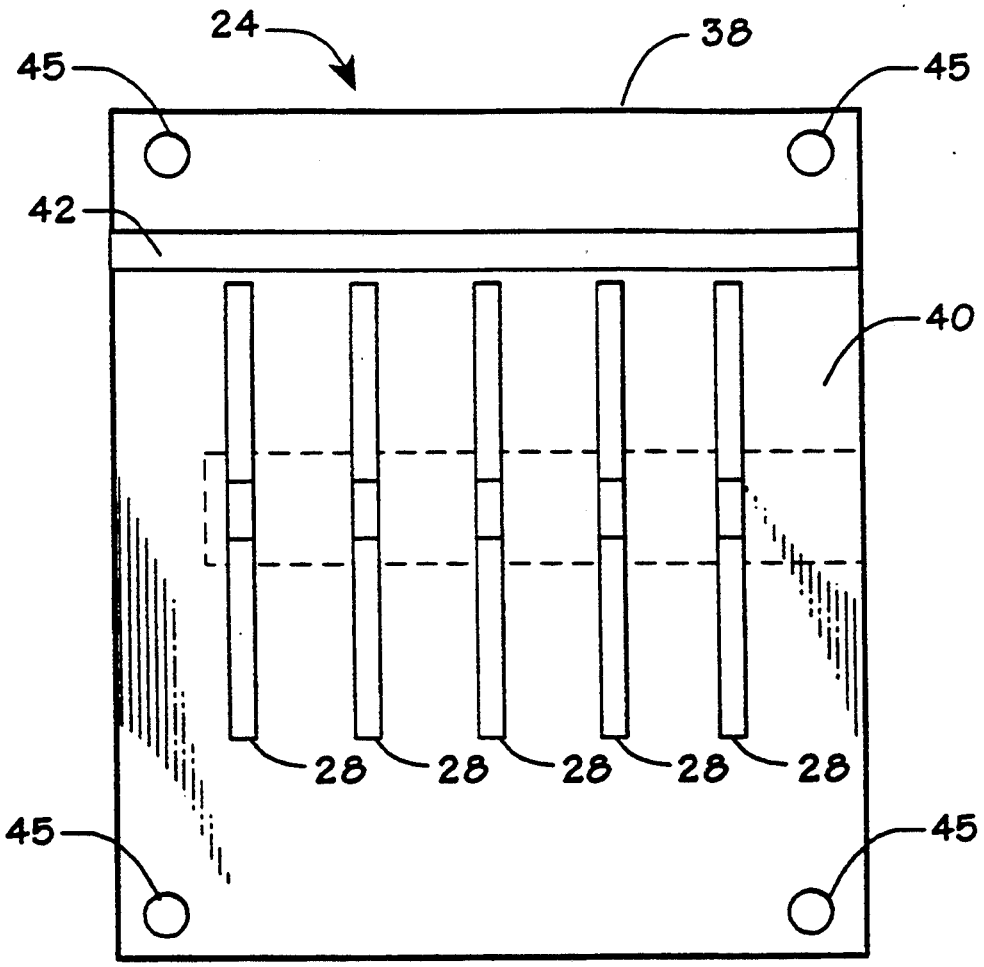
Figure 3C:
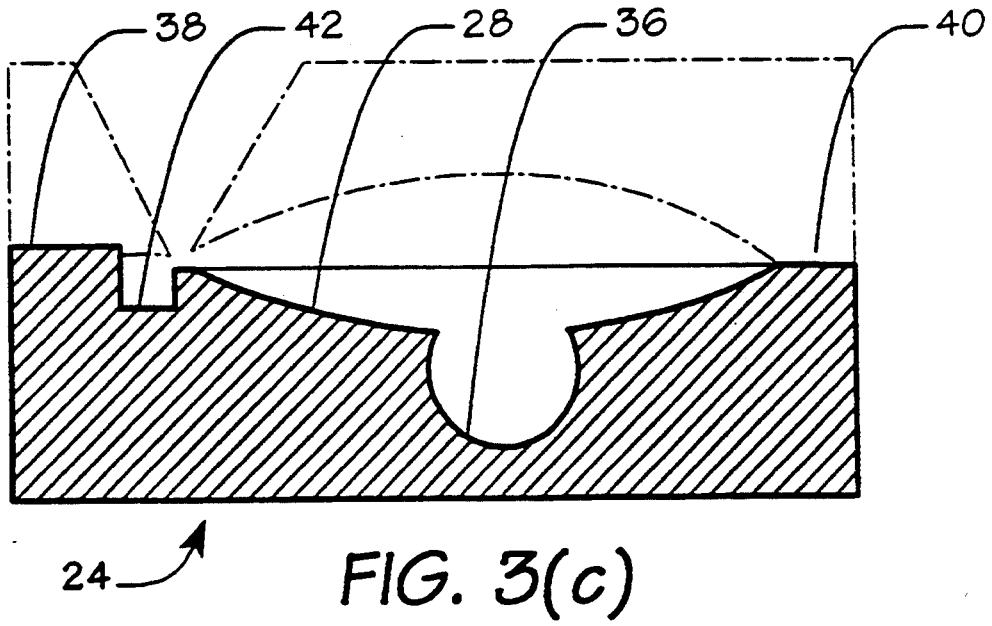
Figure 4A:
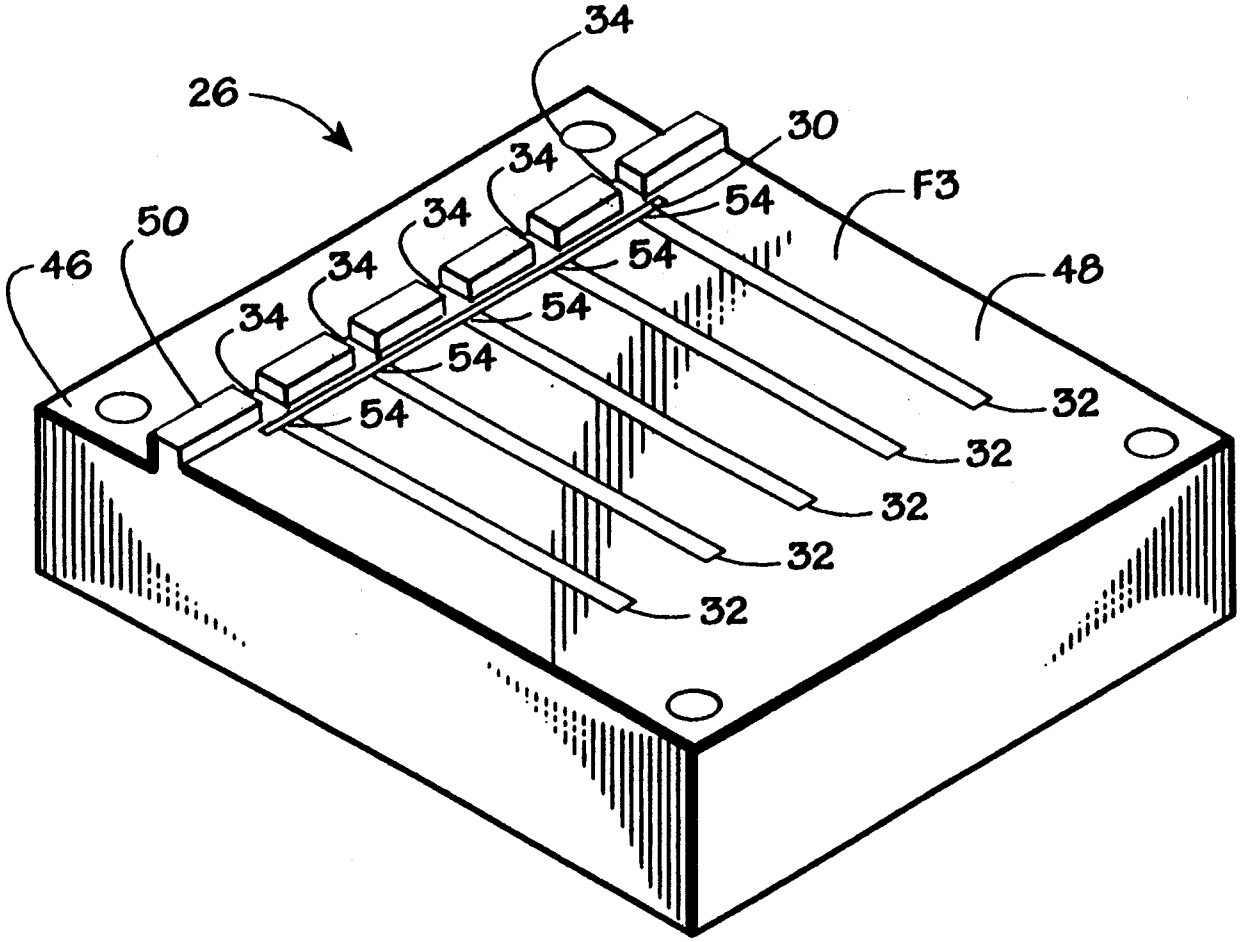
FIG. 4(*a*) is an illustration of a horn block which forms one portion of an ultrasonic transmitter in accordance with a first preferred form of the present invention.
Figure 4B:
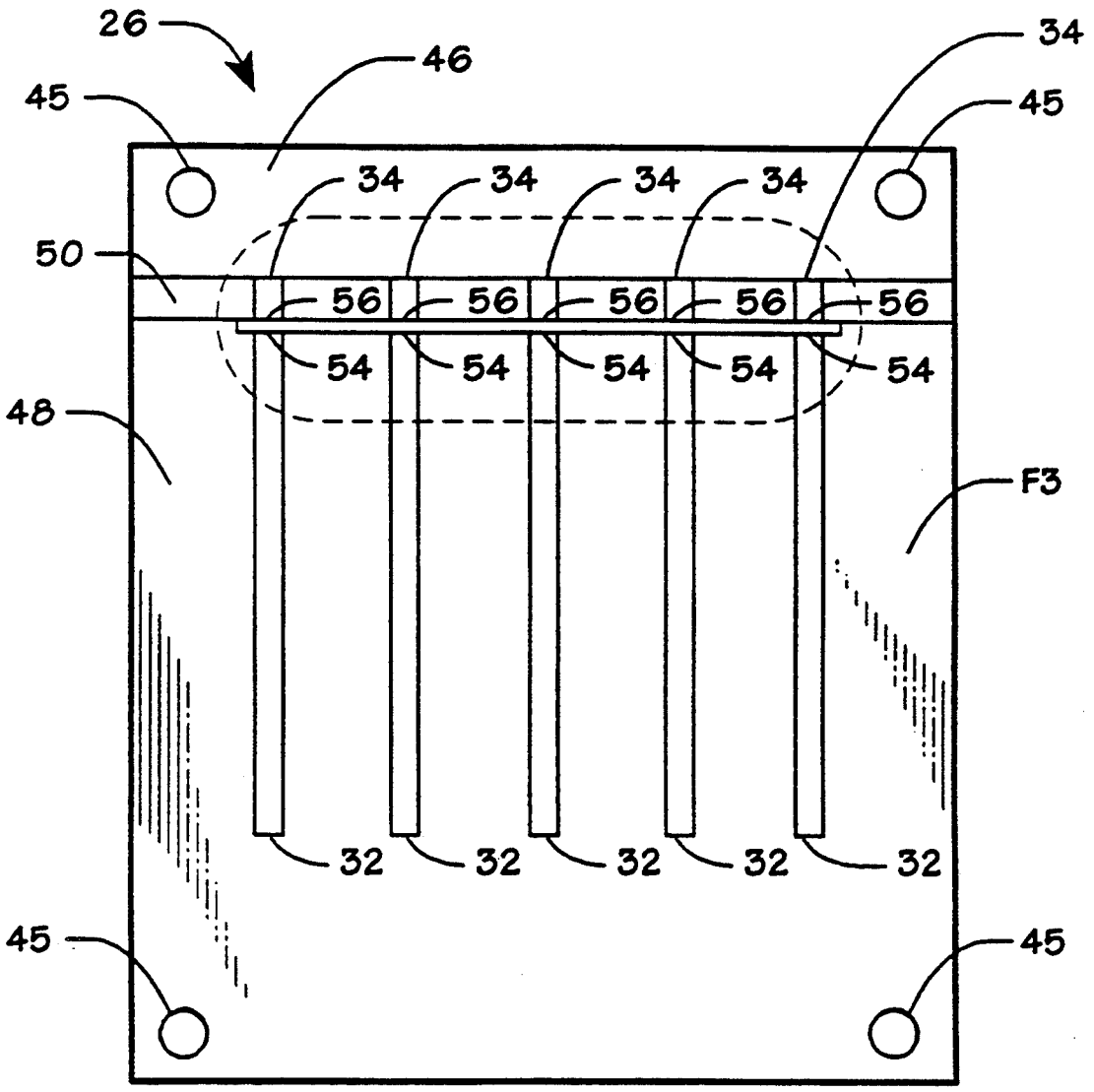
Figure 4C:
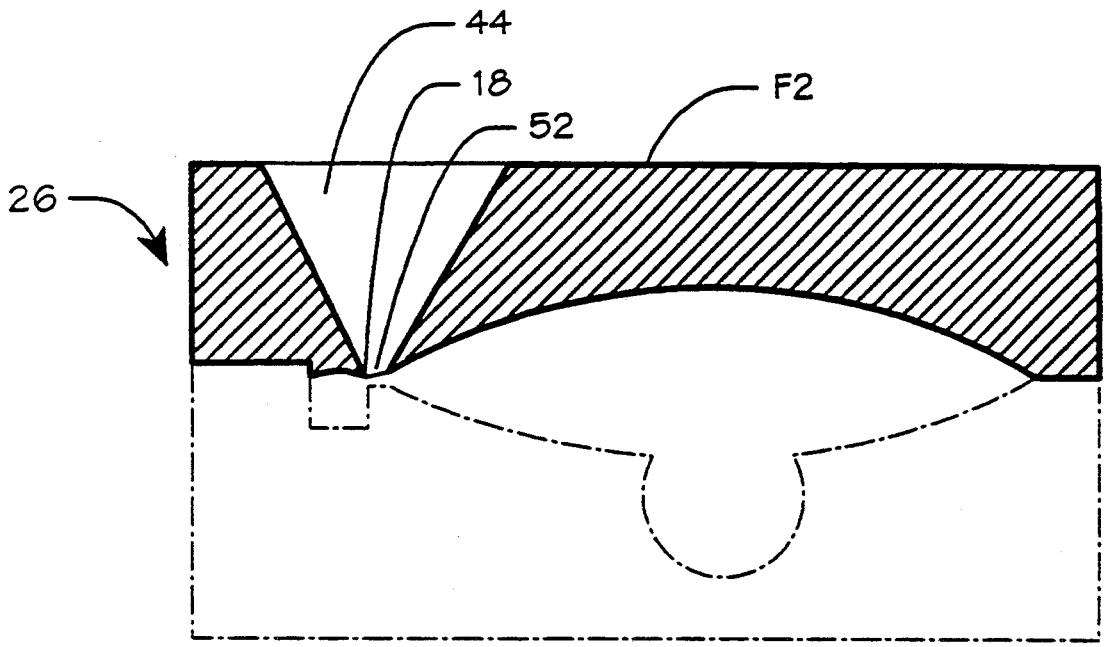
Figure 4D:
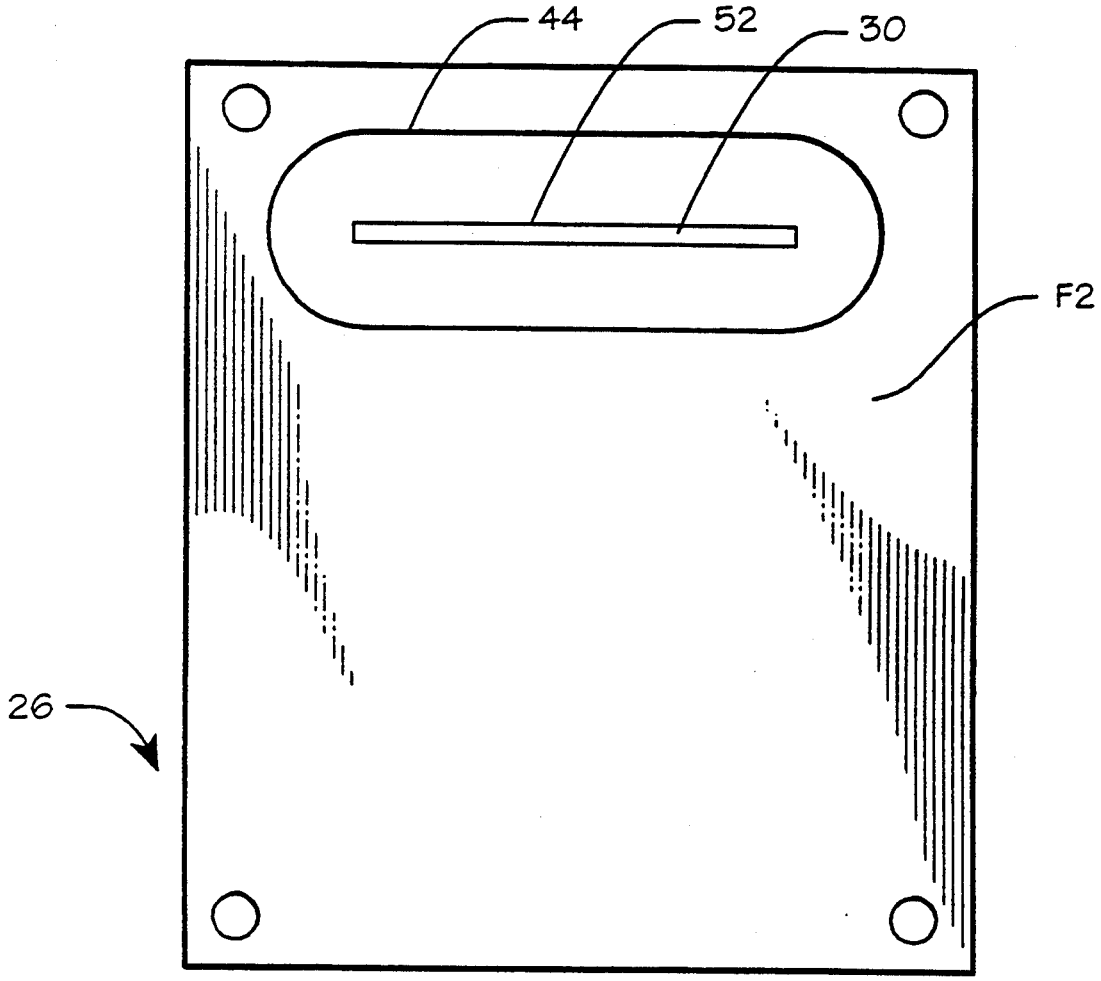

Turning now to FIG. 2, in one preferred form the ultrasonic transmitter 22 of the present invention comprises a pair of blocks 24 and 26 which are capable of mating in a tongue and groove fashion, and which have a plurality of cuts 28, 30, 32, and 34 (shown in FIGS. 3(*a*)–(*c*), and 4(*a*)–(*d*)) formed therein. The cuts 28, 30, 32, and 34 comprise various portions of at least one ultrasonic whistle functional unit 1, and when the blocks 24 and 26 are mated, the cuts 28, 30, 32, and 34 combine to form the at least one ultrasonic whistle functional unit 1.

More specifically, as shown in FIGS. 3(*a*)–(*c*), and 4(*a*)–4(*d*), in one preferred form the ultrasonic transmitter of the present invention comprises a manifold block 24 and a horn block 26. The manifold block 24 has a hole 36 comprising a manifold 2 formed therein. The hole 36 is formed in one side S1 of the manifold block 24 and extends inwardly beneath the upper face F1 of the manifold block 24. The upper face F1 of the manifold block 24 comprises two surfaces 38 and 40 separated by a channel 42. Notably, in the preferred form one surface 38 is elevated above the other surface 40, and a plurality of parallel, arcuate cuts or slots 28, are formed in the less elevated surface 40. The arcuate cuts 28 are spaced equidistantly from one another and extend downwardly through the manifold block 24 to the hole 36. Accordingly, fluid communication is achieved between the arcuate cuts 28 and the manifold hole 36.

The horn block 26 has an acoustic horn 44 formed in its upper face F2 and a plurality of cuts 30–34 formed in its lower face F3. The lower face F3 of horn block 26, which is shaped to fit tightly against the upper face F1 of the manifold block 24 in a tongue and groove fashion, comprises two surfaces 46 and 48 separated by a raised tongue 50. The surface 48, which fits against the less elevated surface 40 of the manifold block 24, when the blocks 24 and 26 are coupled together, has a primary arcuate cut 30 and a plurality of secondary arcuate cuts 32 formed therein. The primary arcuate cut 30 is disposed adjacent the raised tongue 50 and extends through the horn block 26 to a base portion 52 of the acoustic horn 44. The secondary arcuate cuts 32 are equidistantly spaced and intersect the primary cut 30 at one end 54. In addition, the secondary arcuate cuts 32 are spaced and dimensioned such that they correspond to the arcuate cuts 28 formed in the manifold block 24. Thus, when the blocks 24 and 26 are coupled together, the respective arcuate cuts 28 and 32 combine to form the settling chambers 4 of a plurality of ultrasonic whistle functional units 1. Finally, a plurality of arcuate cuts 34 are also formed in the raised tongue 50. The arcuate cuts 34 located in the raised tongue 50 are collinear with and have the same width as the secondary arcuate cuts 32 formed in the surface 48. Thus, when the raised tongue 50 is received by the channel 42 (i.e. when the blocks 24 and 26 are coupled together), the arcuate cuts 34 disposed in the raised tongue 50 form the resonating chambers 6 of a plurality of ultrasonic whistle functional units 1. In addition, the edges 56 of the arcuate cuts 34 which border the primary arcuate cut 30 form the knife-edges 18 of a plurality of ultrasonic whistle functional units 1.

Figure 5:
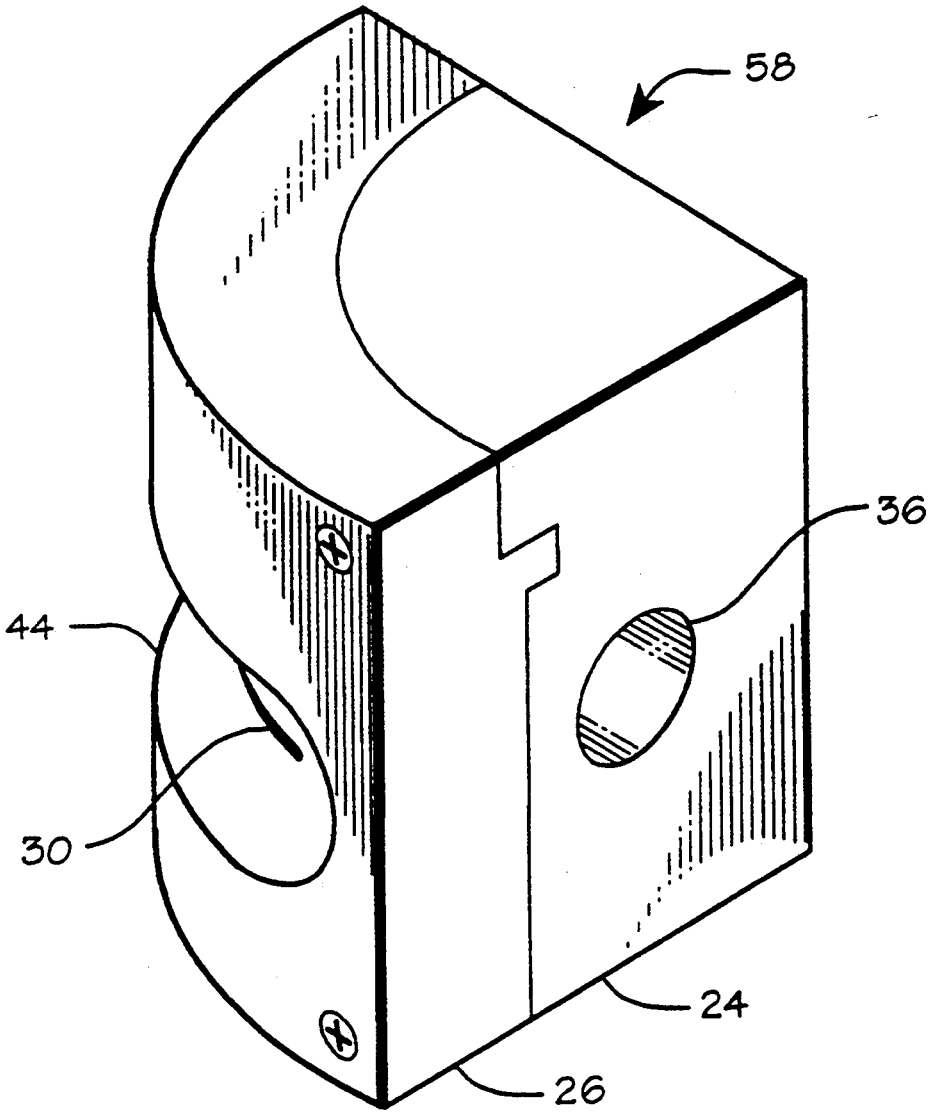
FIG. 5 illustrates a corner mounted ultrasonic transmitter in accordance with a first preferred form of the present invention.
Figure 6A:
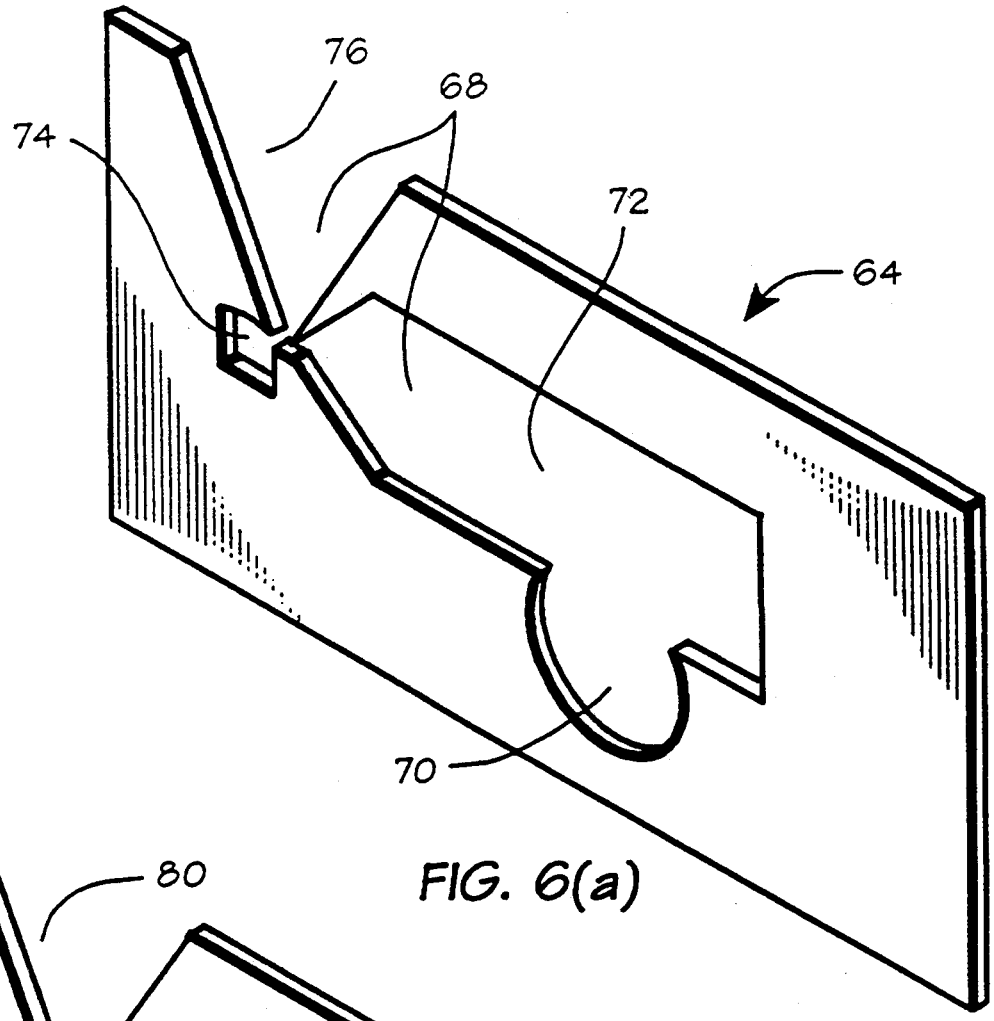
FIG. 6(*a*) illustrates a working unit which forms one portion of an ultrasonic transmitter in accordance with a second preferred form of the present invention.
Figure 6B:
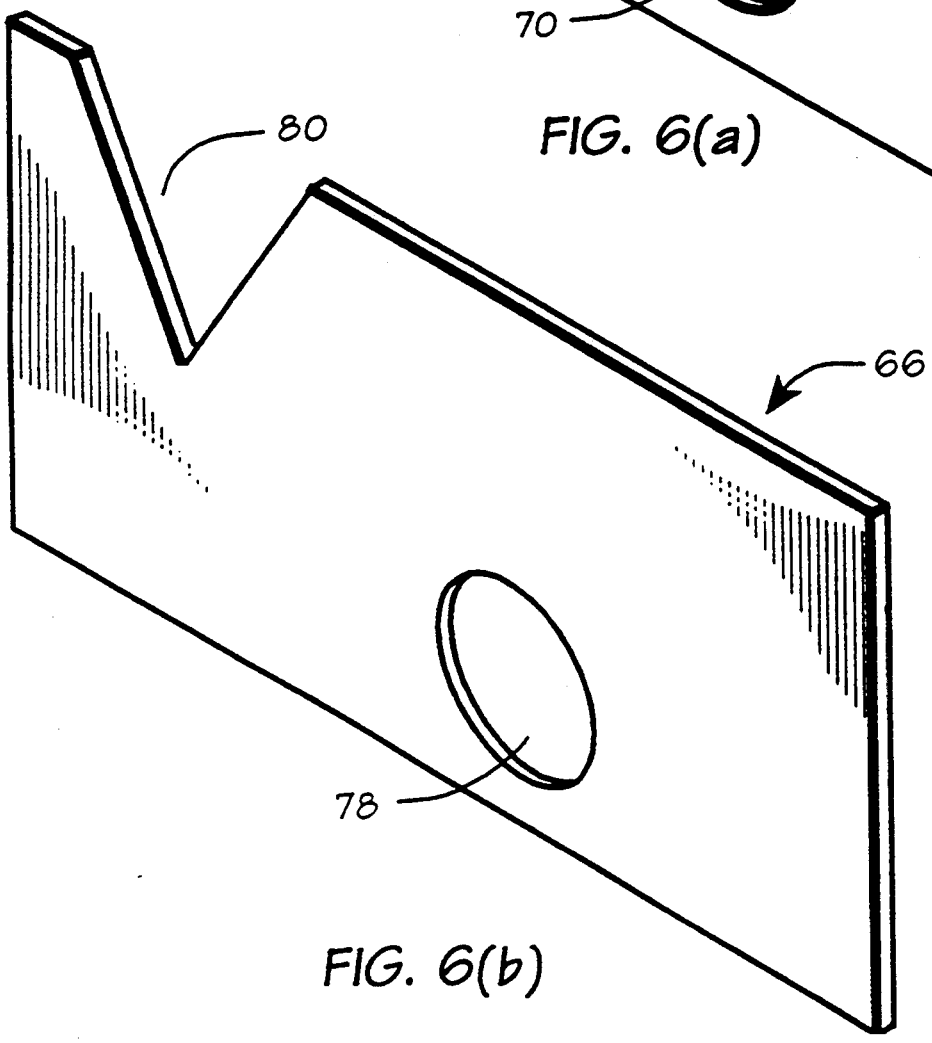
Figure 6C:
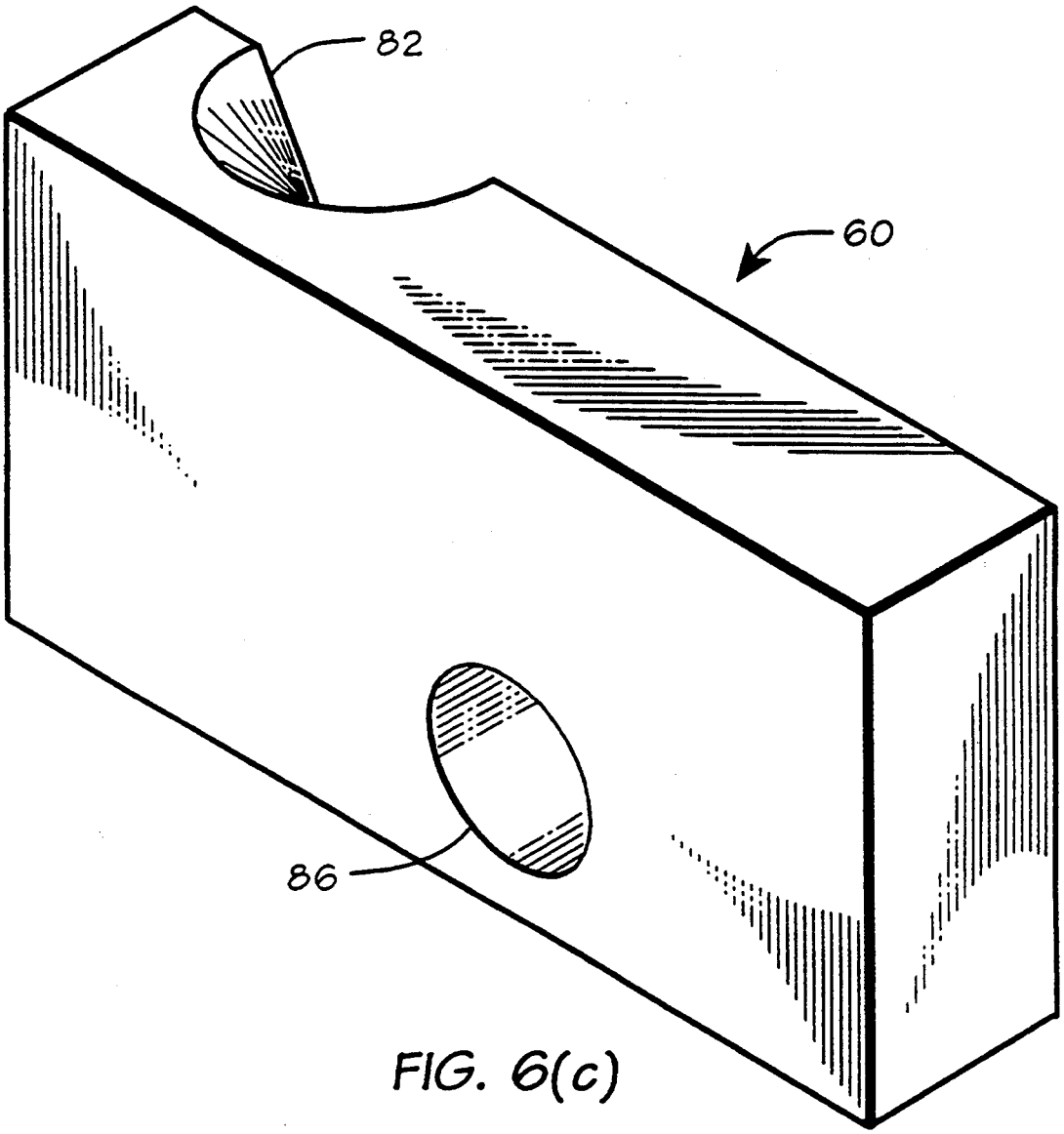
Figure 6D:
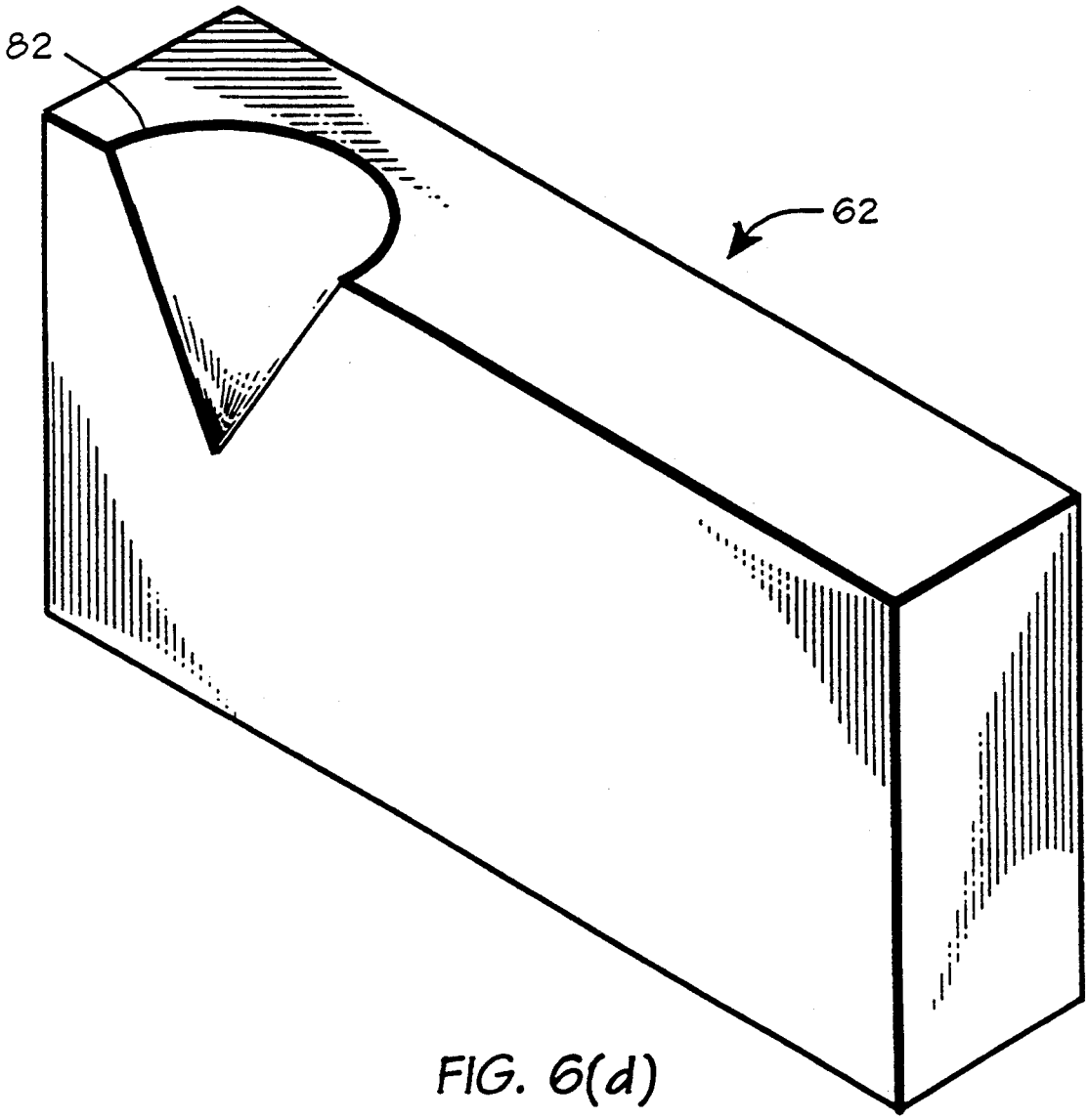

In the presently preferred form, the manifold block 24 and the horn block 26 are constructed from aluminum, and the blocks are coupled together using screws 45 or by other conventional means (i.e. using bolts, glue, etc.). However, those skilled in the art will recognize that blocks 24 and 26 may be constructed from a vast number of other materials, including other metals and plastic resins. Further, the shaping of the blocks and the formation of the cuts are presently performed by conventional means. More specifically, the arcuate cuts 28, 30, 32, and 34 may be formed using a conventional radial saw having a 1.5′ blade radius, the acoustic horn 44 is formed using conventional scooping techniques, and the raised tongue 50 and channel 42 are formed using conventional machine tools. Finally, it should be noted that it is not intended to limit the shape of the blocks to any particular shape, as it is clear that the blocks may be formed in any of a vast number of shapes, and that the blocks may be combined in a vast number of ways. For example, the corner mounted unit 58, which is illustrated in FIG. 5, may be readily combined with other corner mounted units to produce a semi-cylindrical unit, and so on.

Turning now to FIGS. 6(*a*)–(*d*), and 7, in another preferred form the ultrasonic transmitter 22 of the present invention comprises a pair of end units 60 and 62, one or more working units 64 disposed between the end units 60 and 62, and (if desired) one or more spacer units 66 disposed between or adjacent to the working units 64. When the various units comprising the ultrasonic transmitter 22 are coupled together, the "ganged assembly" forms at least one ultrasonic whistle functional unit 1. More specifically, each working unit 64 comprises a plate (or a block) having a multi-regioned aperture 68 formed therein. The multi-regioned aperture 68 comprises a manifold region 70, a reservoir region 72, a resonating chamber region 74, and a horn region 76. It will be appreciated that when a working unit 64 is disposed between (and, is thus bounded by) a pair of end units 60 and 62, a pair of spacer units 66, or a combination thereof, the bounded reservoir region 72 forms a settling chamber 4 of an ultrasonic whistle functional unit 1, and the bounded resonating chamber region 74 forms a resonating chamber 6 of an ultrasonic whistle functional unit 1. In addition, the manifold region 70 forms a section of a manifold 2 which is open to the settling chamber 4, and the horn region 76 forms a section of an acoustic horn 8 which is in fluid communication with the resonating chamber 6.

As for the spacer units 66 (illustrated in FIG. 6(*b*)), and the end units 60 and 62 (illustrated in FIGS. 6(*c*) and (*d*)), each spacer unit 66 has formed therein a first aperture 78 forming a section of a manifold 2 and a second aperture 80 forming a section of an acoustic horn 8. The end units 60 and 62 comprise either a port end unit 60 or a cap end unit 62 and have formed therein at least one aperture 82 forming a semiconical portion of an acoustic horn 8. The port end unit 60 has, in addition, a second aperture 86 formed therein, which aperture 86 comprises a section of a manifold 2. Finally, the aperture 86 may be threaded to provide a means for coupling a fluid delivery tube (shown in FIGS. 9, 10(*a*) and 10(*b*)) to the ultrasonic transmitter 22.

Figure 8A:
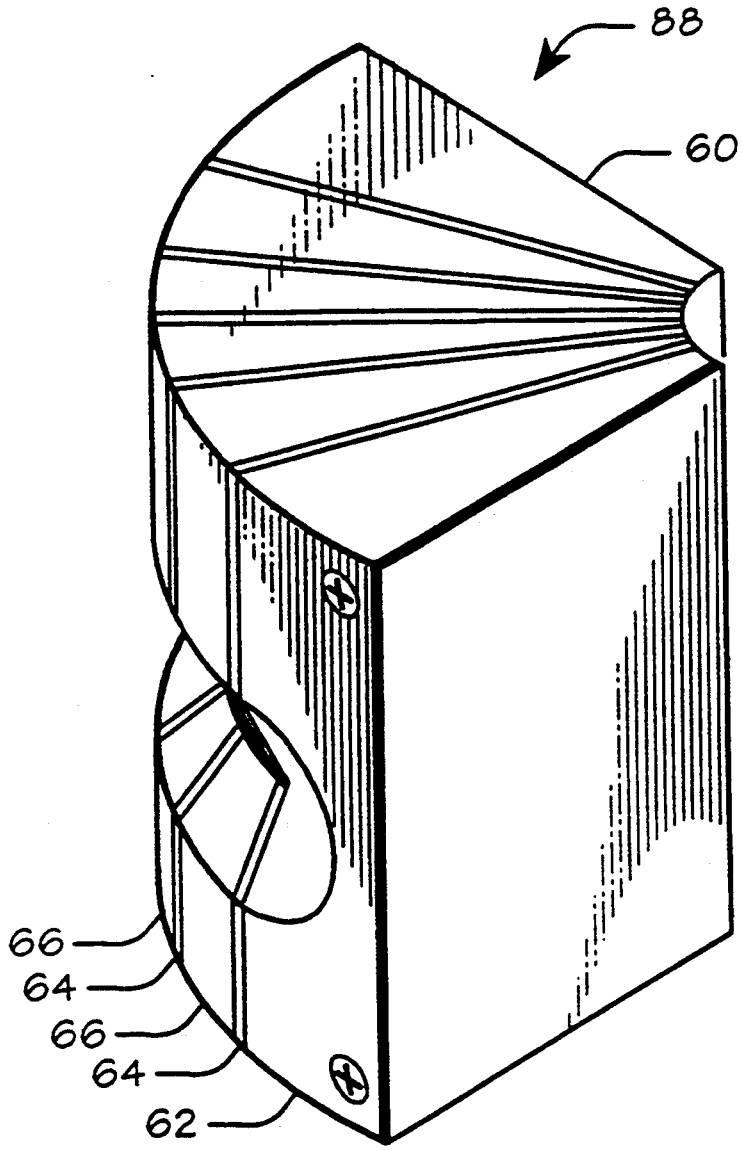
FIG. 8(*a*) illustrates a corner mounted ultrasonic transmitter in accordance with a second preferred form of the present invention.
Figure 8B:
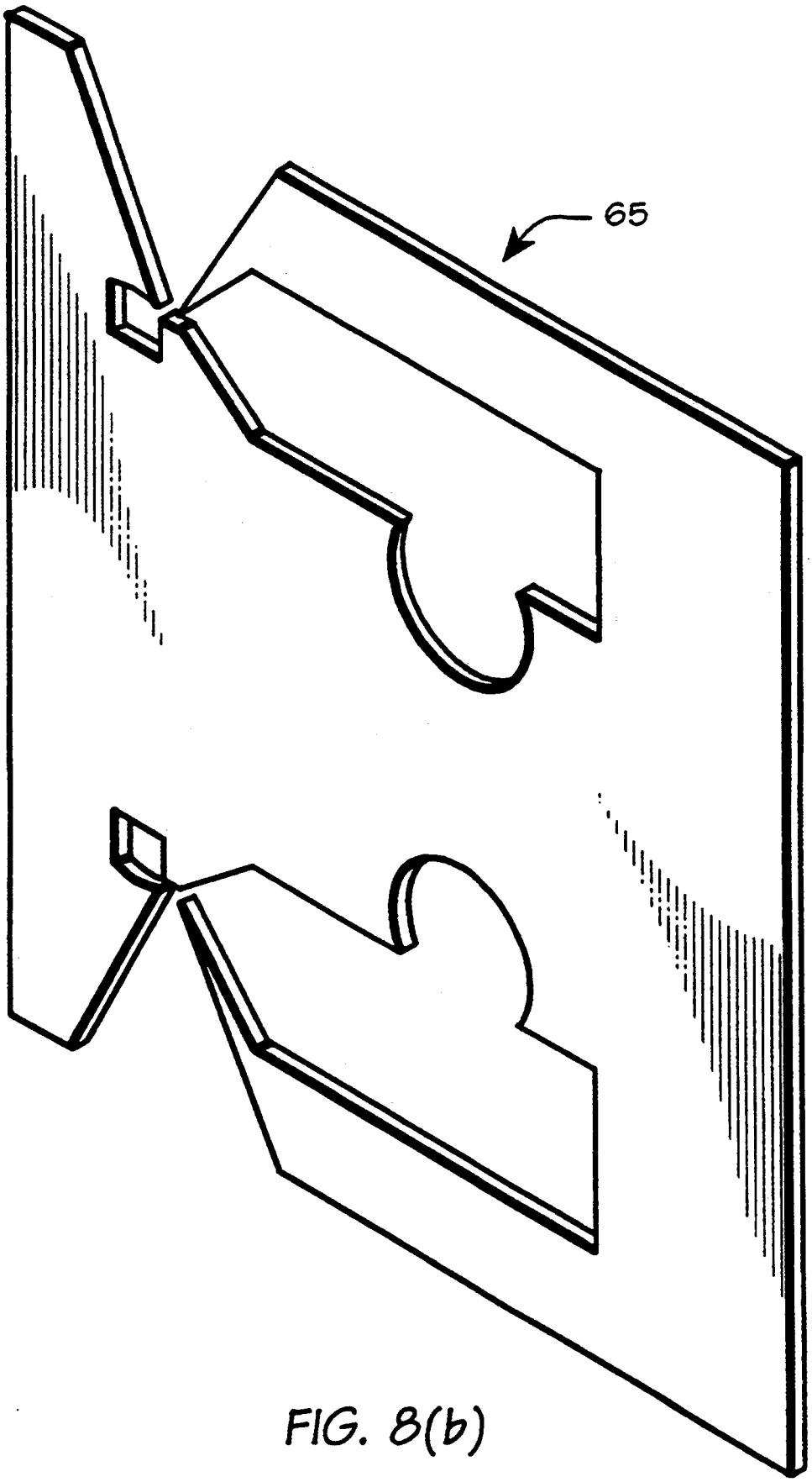

Again, it is presently preferred that the various units 60–66 comprising each ultrasonic transmitter 22 be formed from aluminum, that the various units 60–66 be dimensioned as set forth above to produce ultrasonic waves falling within a frequency band centered at approximately 28 KHz, that the apertures be stamped out by conventional means, and that the various units 60–66 be coupled together by screws (not shown) or other conventional means. However, it is appreciated that the various units 60–66 comprising each ultrasonic transmitter 22 may be formed from other metals or plastics, and that those units 60–66 may be constructed in many ways, such as by injection molding. Further, it is appreciated that, by varying the shape or dimensions of the various units 60–66 or by varying the shape and dimensions of the multi-regioned aperture 68 formed within the working unit(s) 64, the ultrasonic transmitter 22 may be readily modified to maximize coverage of a given area. For example, a corner mounted ultrasonic transmitter 88 in accordance with the second preferred form of the present invention is depicted in FIG. 8(*a*), and a working unit 65 capable of bidirectional ultrasonic wave generation is depicted in FIG. 8(*b*).

Figure 9:
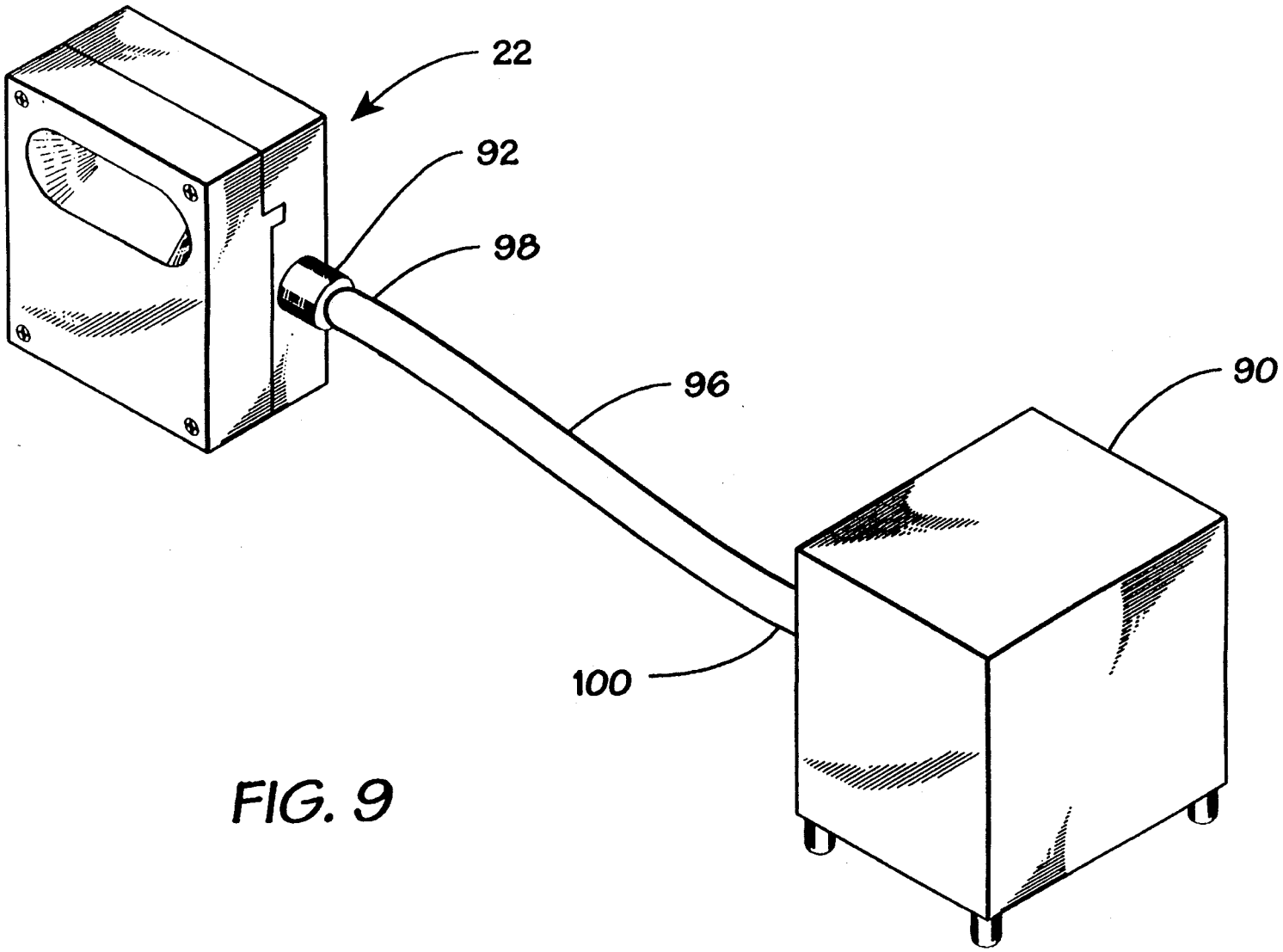
FIG. 9 illustrates the connection of an ultrasonic transmitter in accordance with the present invention to a pressurized fluid source.

In either of the above described embodiments it is presently preferred to provide five (5) ultrasonic whistle functional units 1 within each ultrasonic transmitter 22, and it is preferred to operate each ultrasonic transmitter 22 at a pressure between 2 and 7 psi and a fluid (air) flow rate of approximately 4 $ft^3$/min. At these operating parameters, the ultrasonic transmitter 22 of the present invention is capable of bathing a hemisphere having a radius of 100 ft. in ultrasonic waves having a magnitude of at least 100 db. Further, as shown in FIG. 9, a conventional low pressure fluid (air) pump 90, such as the Whisper 500, manufactured by Second Nature Inc. of Oakland, New Jersey, may be used to drive the ultrasonic transmitter 22 at the preferred operating parameters. The fluid pump 90 serves as a pressurized fluid source and may be coupled to the ultrasonic transmitter 22 by conventional means. For example, it is presently preferred to provide a threaded fitting 92 at the opening 94 of the manifold 2 (shown in FIG. 2), such that a rubber or plastic hose 96 may be readily coupled at one end 98 to the ultrasonic transmitter 22, and it is preferable to attach the other end 100 of the hose 96 to the fluid pump 90 in a similar fashion.

Figure 10:
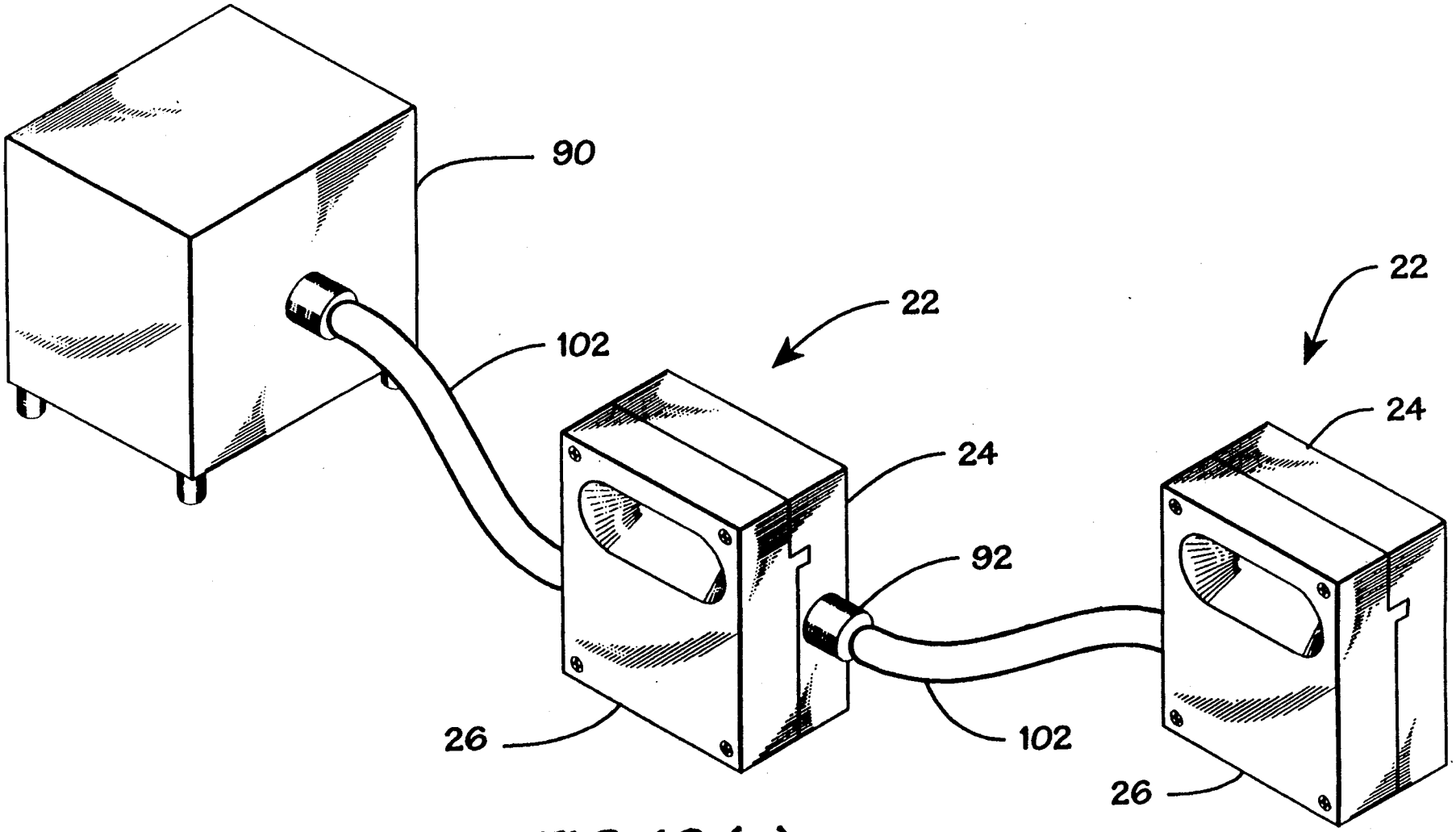
FIG. 10(*a*) illustrates the connection of a plurality of ultrasonic transmitters along a common fluid source line.
Figure 10:
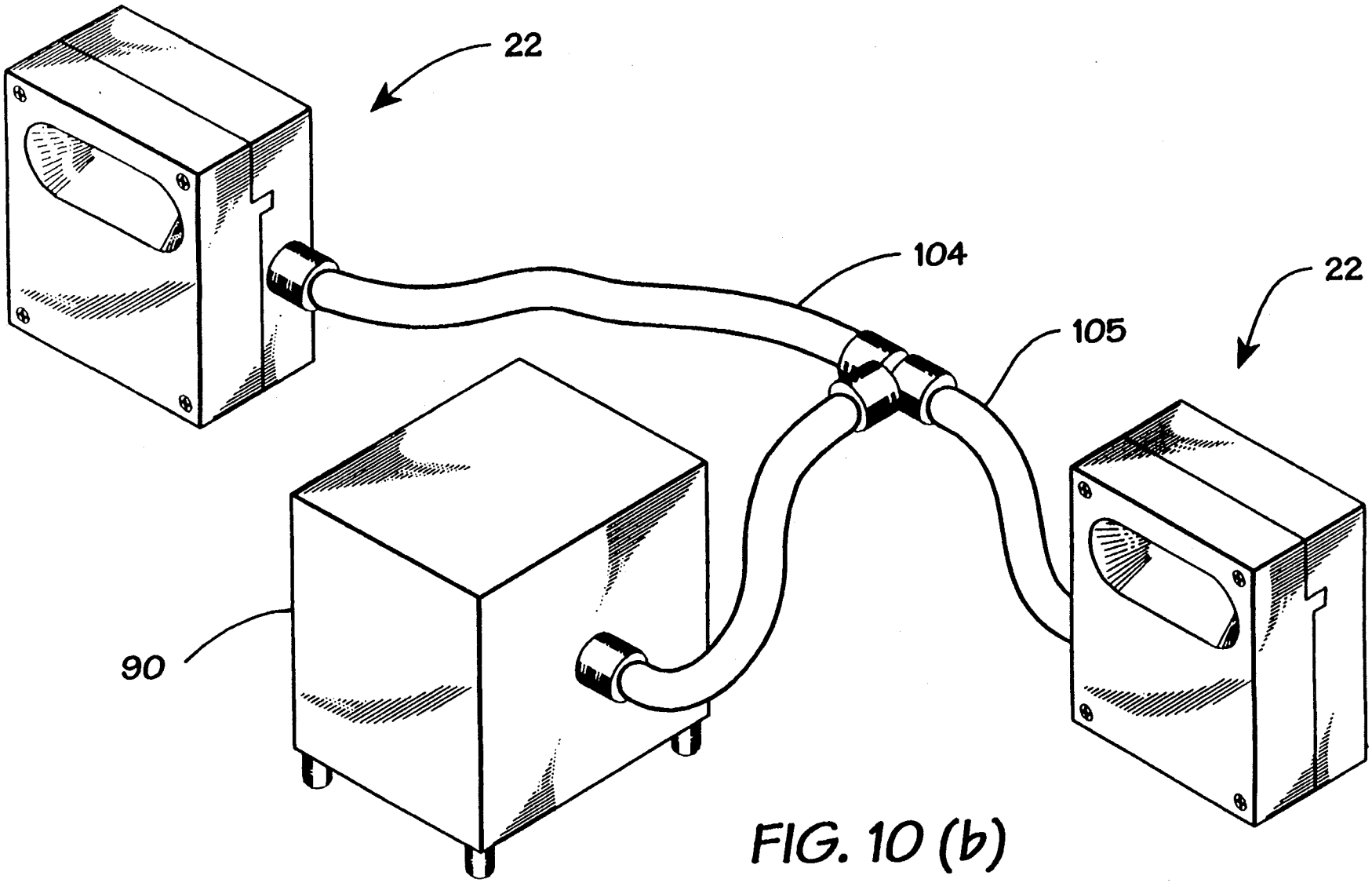

Finally, it will be appreciated that the ultrasonic transmitter 22 of the present invention is modular in nature. Thus, numerous devices 22 may be provided along a common line 102 as shown in FIG. 10(*a*), or along separate lines 104 and 105 as shown in FIG. 10(*b*). The modular construction provides for a maximization of overall system efficiency, because it provides a simple and effective means for addressing acoustic obstructions, such as walls etc., within a given structure.

While the present invention is susceptible to various modifications and alternative forms, specific examples thereof have been shown by way of example in the drawings and are herein described in detail. It should be understood, however, that it is not intended to limit the invention to the particular forms disclosed, but on the contrary, the invention is to cover all modifications, equivalents, and alternatives falling within the spirit and scope of the invention as defined by the appended claims.

What is claimed is:

1. An ultrasonic pest control device comprising:

a first block, a second block, and means for coupling said first and second blocks together, said first and second blocks when coupled together forming at least one ultrasonic whistle in fluid communication with a manifold and an acoustic horn;

said first block comprising a first face and a second face opposite said first face, said first face having said acoustic horn formed therein, and said second face comprising a first surface and a second surface separated by a raised tongue;

said first surface having a primary cut and at least one secondary cut formed therein, said primary cut having one edge bordering said raised tongue and having another edge intersecting said at least one secondary cut, and said primary cut extending through said first block to said acoustic horn;

said raised tongue having at least one tertiary cut formed therein, a base portion of said at least one tertiary cut forming a knife edge across from said intersection of said at least one secondary cut and said primary cut;

said second block comprising a third face and having said manifold formed therein, said manifold being adapted to receive fluid from a fluid source, said third face comprising a third surface and a fourth surface separated by a channel;

said channel being adapted to slideably receive said raised tongue of said first block, said third surface having at least one cut formed therein, said at least one cut corresponding to said at least one secondary cut of said first block, and said manifold being in fluid communication with said at least one cut.

2. A ultrasonic pest control device comprising:

a plurality of blocks which, when coupled together, form an ultrasonic whistle in fluid communication with a manifold and an acoustic horn;

said plurality of blocks comprising a cap end unit, a port end unit, and at least one working unit;

said at lest one working unit having a multi-regioned aperture formed therein, said multi-regioned aperture, when disposed between said end units, forming an ultrasonic whistle in fluid communication with a section of a manifold and a section of an acoustic horn; and said multi-regioned aperture comprising a substantially circular manifold region, a reservoir region, a resonating chamber region, and an acoustic horn region;

said reservoir region being in fluid communication with said manifold region, said resonating chamber region, and said acoustic horn region, and said reservoir region having a tapered distal end for directing a laminar fluid flow against a knife edge formed by an upper surface of said resonating chamber region and an intersecting surface of said acoustic horn region; and said resonating chamber region being configured to generated standing waves within a selected range of frequencies effective for driving pests from a given area;

said cap end unit having a first end portion of said acoustic horn formed therein; and said port end unit having a section of said manifold and a second end portion of said acoustic horn formed therein.

3. A method for constructing an ultrasonic transmitter, said method comprising the steps of:

providing a first block and a second block, said first block having a first face and a second face opposite to said first face, and said second block having a third face;

forming an acoustic horn in said first face of said first block;

cutting said second face of said first block to form a first surface and a second surface separated by raised tongue;

forming a primary cut in said first surface adjacent said raised tongue, said primary cut extending through said first block to said acoustic horn;

forming at least one secondary cut in said first surface, said at least one secondary cut at one end intersecting said primary cut;

forming at least one tertiary cut in said raised tongue, said at least one tertiary cut being collinear with, and having approximately the same width as, said at least one secondary cut;

cutting said third face of said second block to form a third surface and a fourth surface separated by a channel;

forming a manifold hole in said second block, said manifold hole being formed in one side of said second block and extending inwardly beneath said third surface;

forming at least one quaternary cut in said third surface of said second block, said at least one quaternary cut being of similar dimensions to said secondary cuts formed in said first surface of said first block, and said at least one quaternary cut extending through said second block to said manifold hole; and coupling said first and second blocks together in a tongue and groove fashion.

4. The method of claim 3 further comprising the steps of:

coupling a fluid delivery tube at one end to said manifold hole;

coupling a pressurized fluid source to said fluid delivery tube at another end; and providing a fluid flow at a given fluid flow rate and pressure to said manifold hole.

5. The method of claim 4 wherein said fluid flow comprises a flow of air, said fluid flow rate is approximately 4 $ft^3$/min., and said pressure is between approximately 2 and 7 psi.

6. A method for constructing an ultrasonic transmitter, said method comprising the steps of:

providing a plurality of blocks, said plurality of blocks comprising a pair of end units and at least one working unit;

forming a multi-regioned aperture within said at least one working unit, said multi-regioned aperture comprising a manifold region, a reservoir region, a resonating chamber region, and an acoustic horn region;

said reservoir region being in fluid communication with said manifold region, said resonating chamber region, and said acoustic horn region, and said reservoir region having a tapered distal end for directing a laminar fluid flow against a knife edge formed by upper surface of said resonating chamber region and intersecting surface of said acoustic horn region; and said resonating chamber region being configured to generate standing waves within a selected range of frequencies effective for driving pest from a given area;

forming a manifold hole and a first portion of an acoustic horn in a first end unit, said manifold hole being collinear with said manifold region of said multi-regioned aperture, and said first portion of said acoustic horn being collinear with said acoustic horn region of said multi-regioned aperture when said working unit is disposed adjacent said first end unit;

forming a second portion of said acoustic horn in a second end unit, said second portion of said acoustic horn being collinear with said acoustic horn region of said multi-regioned aperture when said working units disposed adjacent said second end unit; and coupling said end units and said at least one working unit together to form at least one ultrasonic whistle in fluid communication with a manifold and an acoustic horn.

7. The method of claim 6 further comprising the steps of:

coupling a fluid delivery tube at one end to said manifold hole;

coupling a pressurized fluid source to said fluid delivery tube at another end; and providing a fluid flow at a given fluid flow rate and pressure to said manifold hole.

8. The method of claim 7 wherein said fluid flow comprises a flow of air, said fluid flow rate is approximately 4 $ft^3$/min., and said pressure is between approximately 2 and 7 psi.

9. The method of claim 8 further comprising the steps of:

providing a plurality of spacer units;

forming a manifold hole and a second section of an acoustic horn within each of said spacer units, said manifold hole being collinear with said manifold region of said multi-regioned aperture when said spacer units are disposed adjacent said at least one working unit, and said second section of said acoustic horn being collinear with said acoustic horn region of said multi-regioned aperture when said spacer units are disposed adjacent said at least one working unit; and disposing said spacer units between a plurality of working units, such that, when said end units, said working units, and said spacer units are coupled together, a plurality of ultrasonic whistles are produced, said ultrasonic whistles being in fluid communication with said manifold and said acoustic horn.

10. The ultrasonic pest control device of claim 1 further comprising a pressurized fluid source and a fluid delivery tube being capable of coupled at one to said pressurized fluid source and at another end to said manifold, and said pressurized fluid source being capable of delivering fluid at a given fluid flow rate and a given pressure to said at least one ultrasonic whistle.

11. The ultrasonic pest control device of claim 10 wherein said least one ultrasonic whistle in response to the delivery of said fluid from said pressurized fluid source generates ultrasonic waves in a frequency band centered at approximately 28 kHz.

12. The ultrasonic pest control device of claim 11 wherein said fluid delivered by said pressurized fluid source is air, said fluid flow rate is approximately 4 $ft/^3min.$, and said pressure is between 2 and 7 psi.

13. The ultrasonic pest control device of claim 2 further comprising a pressurized fluid source and a fluid delivery tube being capable of coupled at one to said pressurized fluid source and at another end to said manifold, and said pressurized fluid source being capable of delivering fluid at a given fluid flow rate and a given pressure to said at least one ultrasonic whistle.

14. The ultrasonic pest control device of claim 13 wherein said least one ultrasonic whistle in response to the delivery of said fluid from said pressurized fluid source generates ultrasonic waves in a frequency band centered at approximately 28 kHz.

15. The ultrasonic pest control device of claim 14 wherein said fluid delivered by said pressurized fluid source is air, said fluid flow rate is approximately 4 $ft/^3min.$, and said pressure is between 2 and 7 psi.

* * * * *